US010429095B2

(12) United States Patent
Schmidt

(10) Patent No.: US 10,429,095 B2
(45) Date of Patent: Oct. 1, 2019

(54) SCHMITTY COMPRESSOR

(71) Applicant: Todd Gerard Schmidt, Shelby Township, MI (US)

(72) Inventor: Todd Gerard Schmidt, Shelby Township, MI (US)

( * ) Notice: Subject to any disclaimer, the term of this patent is extended or adjusted under 35 U.S.C. 154(b) by 479 days.

(21) Appl. No.: 15/015,470

(22) Filed: Feb. 4, 2016

(65) Prior Publication Data

US 2016/0223223 A1 Aug. 4, 2016

Related U.S. Application Data

(60) Provisional application No. 62/125,889, filed on Feb. 4, 2015.

(51) Int. Cl.
*F24H 1/14* (2006.01)

(52) U.S. Cl.
CPC ..... *F24H 1/145* (2013.01)

(58) Field of Classification Search
CPC ..... F24H 1/145
USPC ..... 122/18.4
See application file for complete search history.

(56) References Cited

U.S. PATENT DOCUMENTS 1,714,836 A * 5/1929 Aikman ..... F04B 27/005 417/432
6,568,911 B1 * 5/2003 Brightwell ..... F04B 9/109 417/243
7,513,224 B2 * 4/2009 Heaton ..... B64D 27/24 123/51 R
2003/0019444 A1 * 1/2003 Suh ..... F02B 11/00 123/70 R
2008/0202454 A1 * 8/2008 Pirault ..... F02B 33/22 123/58.8
2009/0260610 A1 * 10/2009 Walker ..... F41B 11/721 124/73
2010/0288214 A1 * 11/2010 Pelmear ..... F02B 77/14 123/41.86
2015/0300342 A1 * 10/2015 Chou ..... F04B 35/04 417/374
2015/0375598 A1 * 12/2015 Carlson ..... B60H 1/249 137/528

* cited by examiner

*Primary Examiner* — Steven B McAllister
*Assistant Examiner* — John E Bargero
(74) *Attorney, Agent, or Firm* — Howard & Howard Attorneys PLLC

(57) ABSTRACT

A compressor unit for heating and sanitizing water for human use including a combustion housing defining a combustion chamber. A heat exchanger is partially supported in the combustion chamber and configured to heat water. An igniter ignites fuel and air in the combustion chamber. The compressor unit further includes a compression housing defining a compression chamber in fluid communication with the combustion chamber. An intake valve is configured to meter air into the compression chamber. An oscillation plate is supported in the compression chamber and movable between first and second positions wherein movement of the oscillation plate between the two positions compresses air directed toward the combustion chamber. A sealed case around a heat fan and an attached exhaust pipe contain exhaust gasses after a release valve. A case for a crankshaft contains lubrication and is sealed with a lid similar to an oil pan.

23 Claims, 16 Drawing Sheets

SCHMITTY COMPRESSOR

CROSS-REFERENCE TO RELATED APPLICATIONS

The subject patent application claims priority to and all the benefits of U.S. Provisional Patent Application No. 62/125,889 which was filed on Feb. 4, 2015, which is herein incorporated by reference in its entirety. And whereas all pieces claimed and all systems of operation recognized herein are original and without patent infringement. The petitioner hereby requests first to file honors.

BACKGROUND OF THE INVENTION

1. Field of the Invention

The present invention generally relates to a compressor. Shown as a compressor and/or a survival unit utilizing internal combustion to heat water for human use, as well as a motor unit utilizing internal combustion to sustain heat energy.

2. Description of the Related Art

It is well known that water is necessary for survival. Oftentimes the only source of water is from nature. Water may need to be heated prior to consumption in order to remove potentially harmful bacteria. Heated water may also be desirable for preparation of certain meals such as noodles, or to make hot drinks such as coffee.

While conventional water heating methods, such as fire, have generally performed well for their purpose, there remains a need in the art for a self-contained machine to rapidly heat water.

SUMMARY OF THE INVENTION

Accordingly, the present invention provides a compressor and/or a survival unit for heating and sanitizing water for human use. The compressor unit utilizes compressed air mixed with fuel and then burned as a heat source for the water. The compressor unit includes a combustion housing defining a combustion chamber. The fuel and air are burned in the combustion chamber. A compression housing defining a compression chamber is spaced from the combustion housing by a pipe segment disposed in fluid communication with the combustion chamber. An oscillation plate is supported for reciprocal movement in the compression chamber. The oscillation plate moves between a first position and a second position to compress air within the compression chamber. An exhale valve having a magnetic valve seat opens to allow the compressed air to flow into the combustion chamber. By mixing the fuel with compressed air, more heat can be generated than by burning the fuel. The additional heat generated can be used to heat an equivalent volume of water faster, and to a higher temperature, and to heat a larger volume of water to a desired temperature. A heat exchanger is at least partially supported in the combustion chamber to transfer heat into the water. Furthermore, by utilizing internal combustion, risks associated with unintentional ignition of nearby fuel sources are reduced.

Another advantage of the present invention will be readily appreciated as a motor unit. It becomes better understood by reference to the Schmitty Compressor for its components. And, with limited use of metal, it sustains the production of heat.

DETAILED DESCRIPTION OF THE PREFERRED EMBODIMENT(S)

With reference to the Figures, wherein like numerals indicate like parts throughout the several views, a compressor and/or a survival unit 20 for heating and sanitizing water for human use is provided. The compressor unit 20 is shown generally in FIG. 1.

Figure 1:
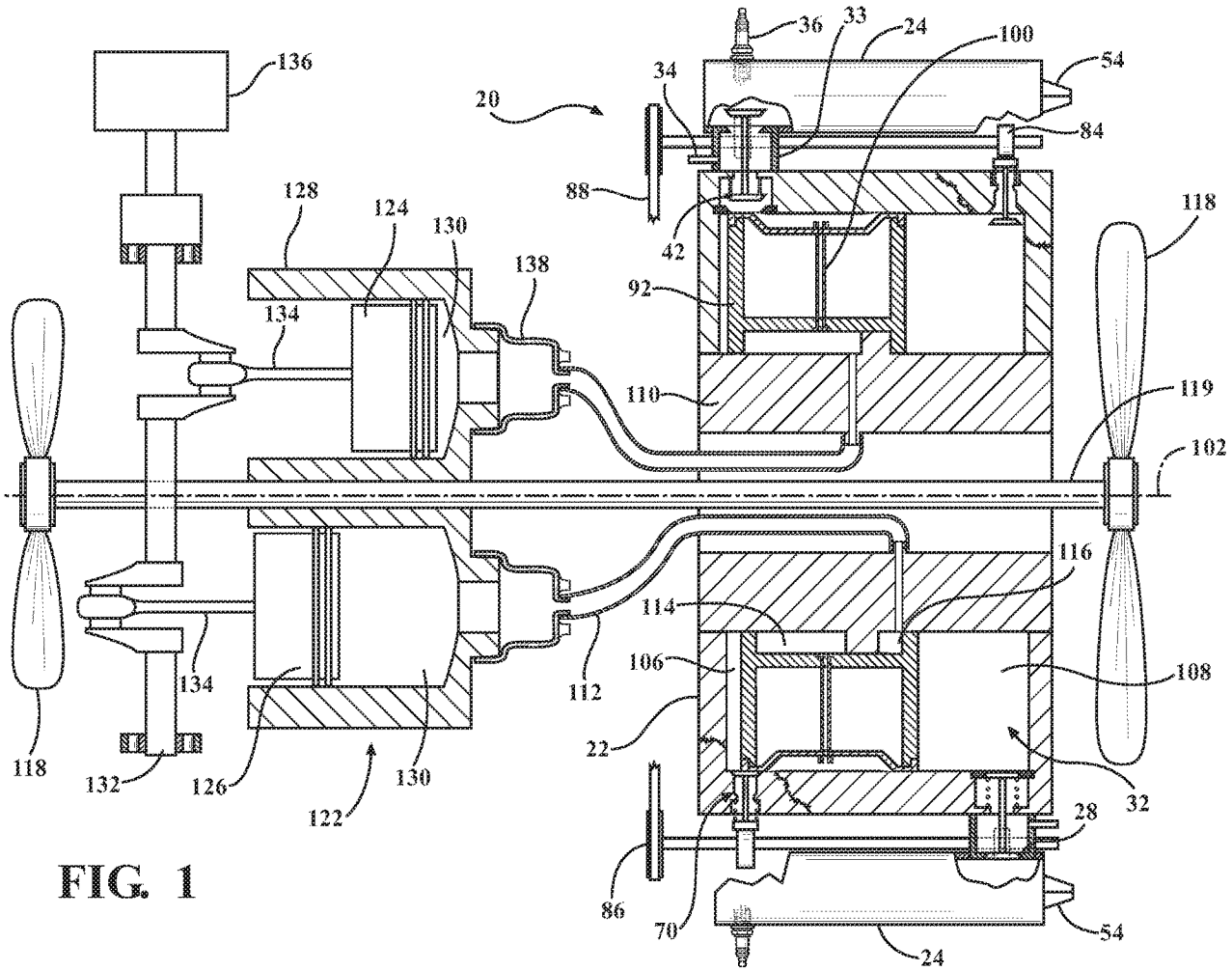
FIG. 1 is a sectional view of a compressor and/or a survival unit according to one embodiment of the present invention.

Referring to FIG. 1, the compressor unit 20 includes a compression housing 22 and a combustion housing 24. The combustion housing 24 is disposed on the compressor unit 20 and is spaced from the compression housing 22. The combustion housing 24 defines a combustion chamber 26 therein and further defines an exhale port 28 and an exhaust port 30. The exhale port 28 provides a passage for air into the combustion chamber 26, and the exhaust port 30 provides an exit path for exhaust gasses. It is to be appreciated that the combustion housing 24 may define more than one exhale port 28 in certain embodiments.

The compression housing 22 is a hollow cylinder that defines a compression chamber 32 therein. The compression housing 22 is coupled to the combustion housing 24 such that the compression chamber 32 is in fluid communication with the combustion chamber 26 at each exhale port 28 by a pipe segment 33. The compression chamber 32 provides a source of air to the combustion chamber 26.

In one embodiment, the combustion housing 24 is further defined as a plurality of combustion housings 24. The combustion housings 24 are radially arranged around the cylindrical compression housing 22. Each of the combustion housings 24 define a combustion chamber 26 therein. Each combustion chamber 26 is in fluid communication with the compression chamber 32. The combustion chambers 26 may be interconnected or discrete.

Figure 2:
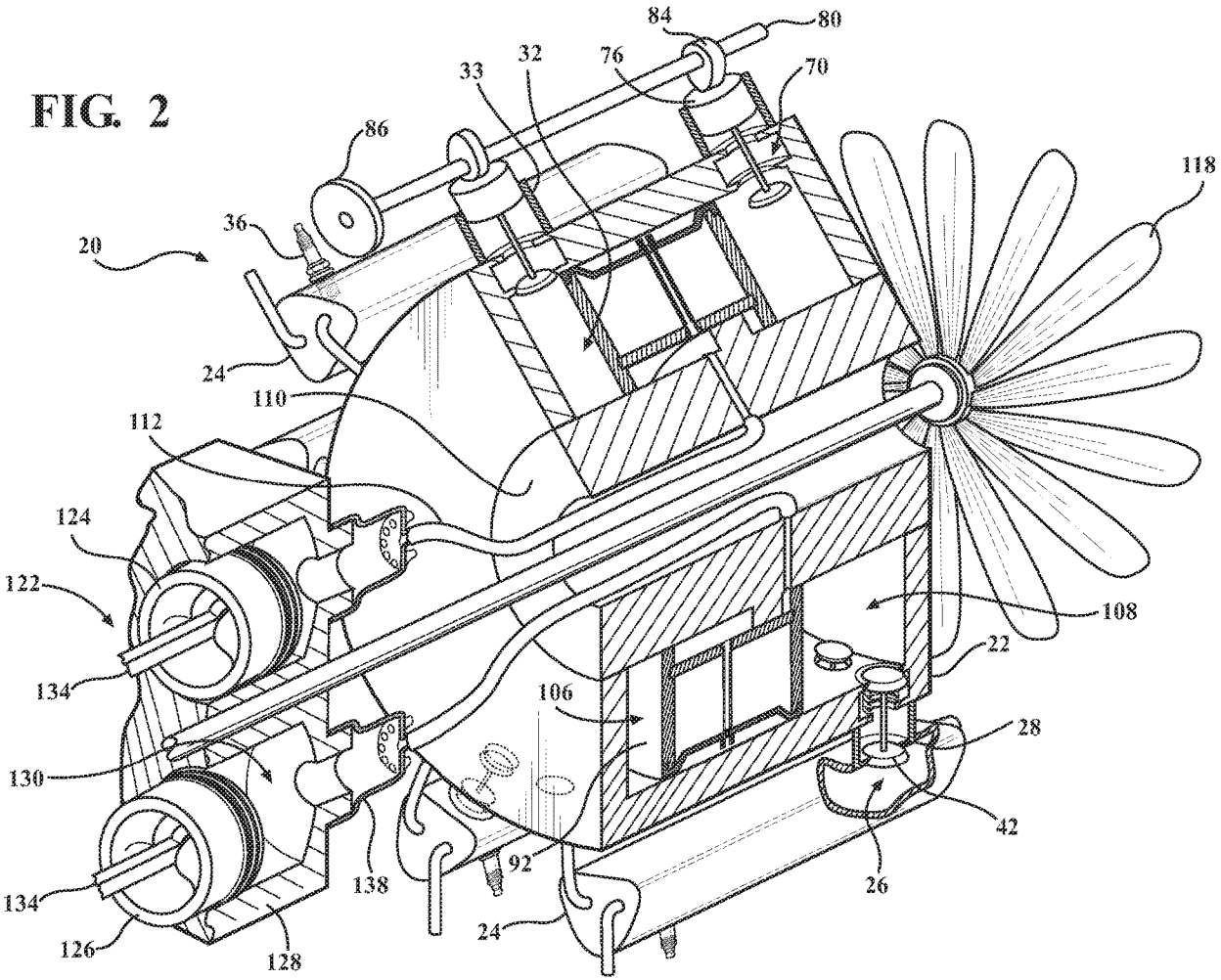
FIG. 2 is a partial sectional view of the compressor unit of FIG. 1.
Figure 3:
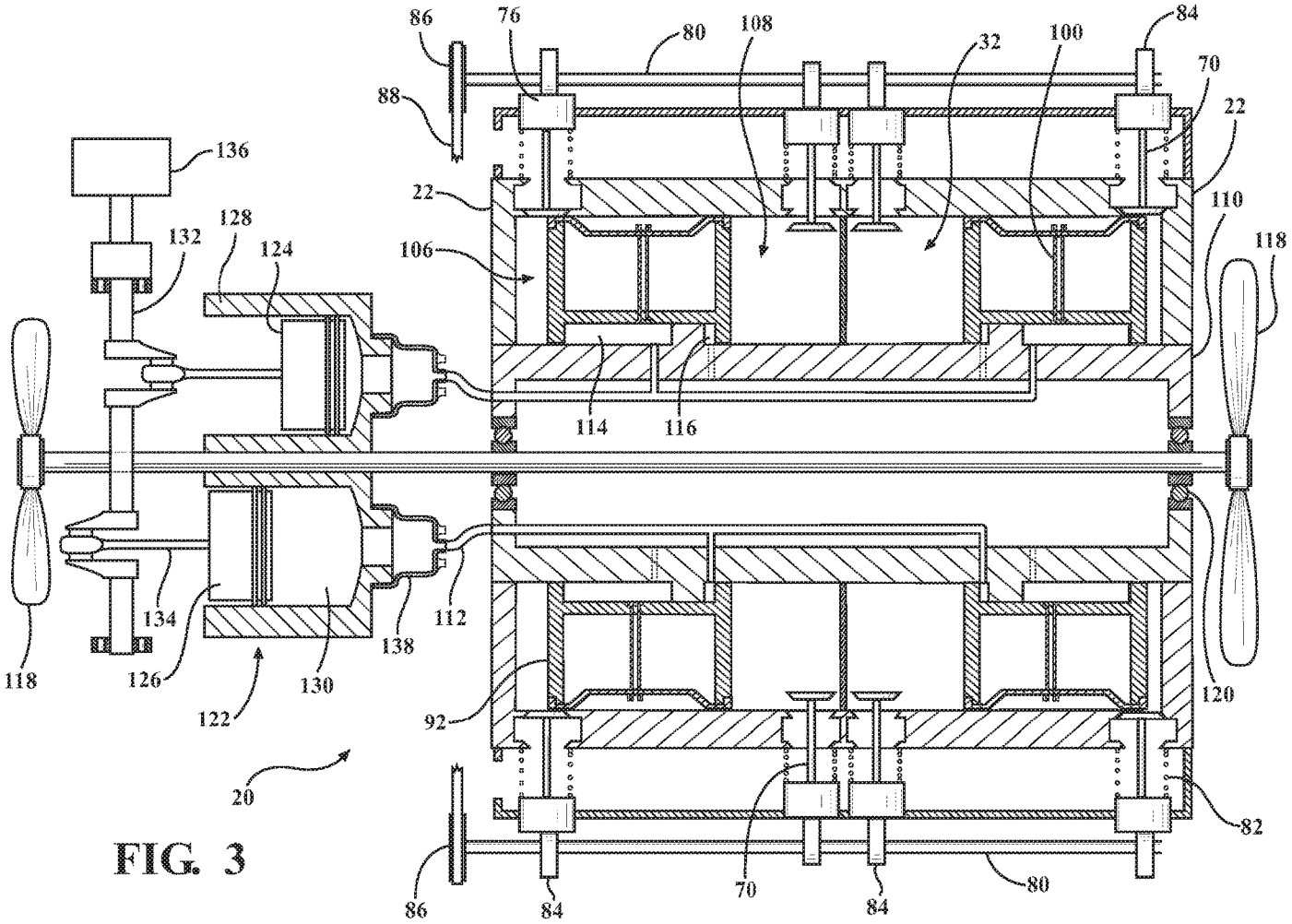
FIG. 3 is a sectional view of a portion of the Twin Compressor—Survival Unit of similar systems according to one embodiment of the present invention.
Figure 4:
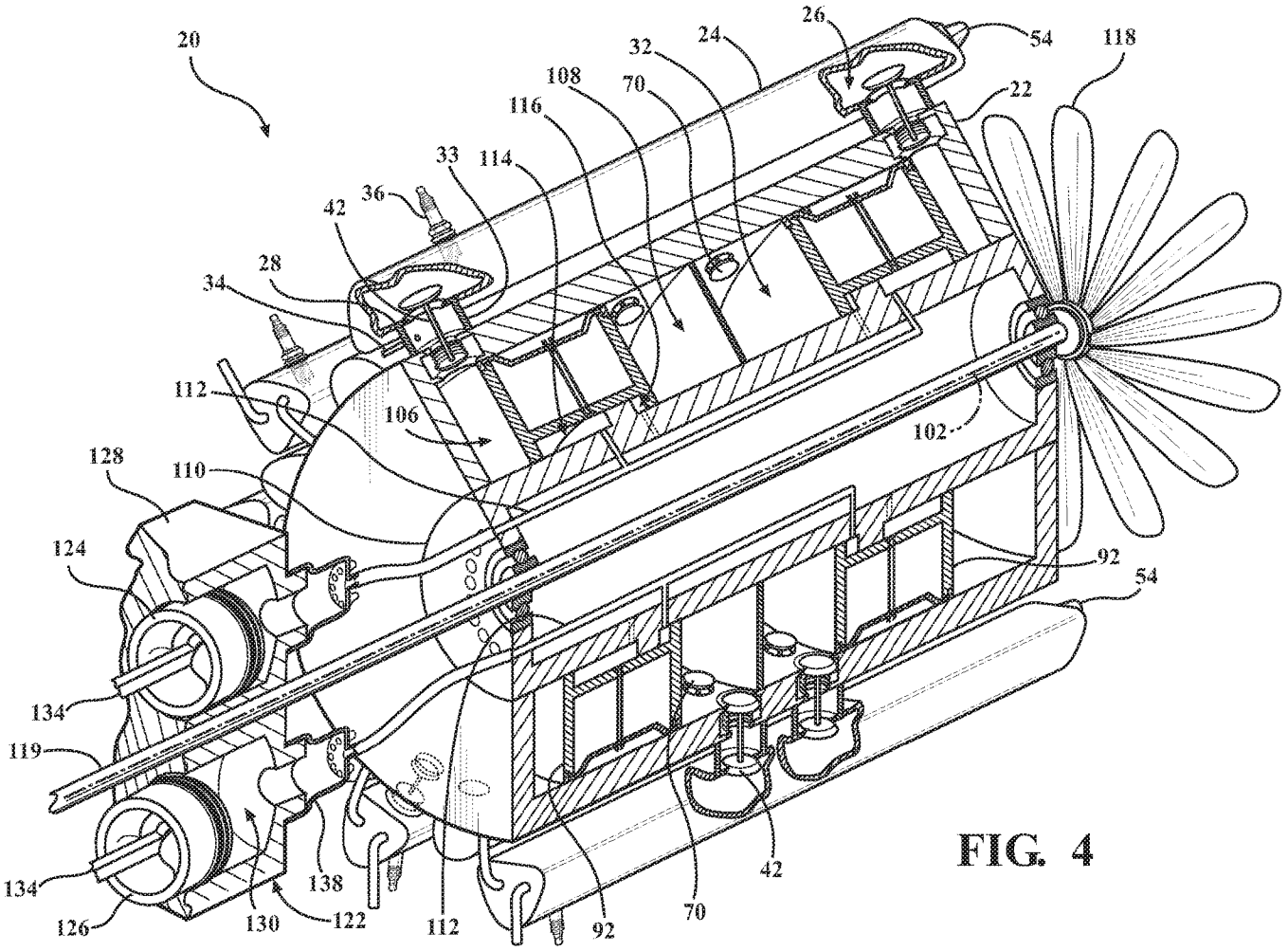
FIG. 4 is a partial sectional view of another embodiment of the Twin Compressor—Survival Unit of similar systems according to one embodiment of the present invention.
Figure 7:
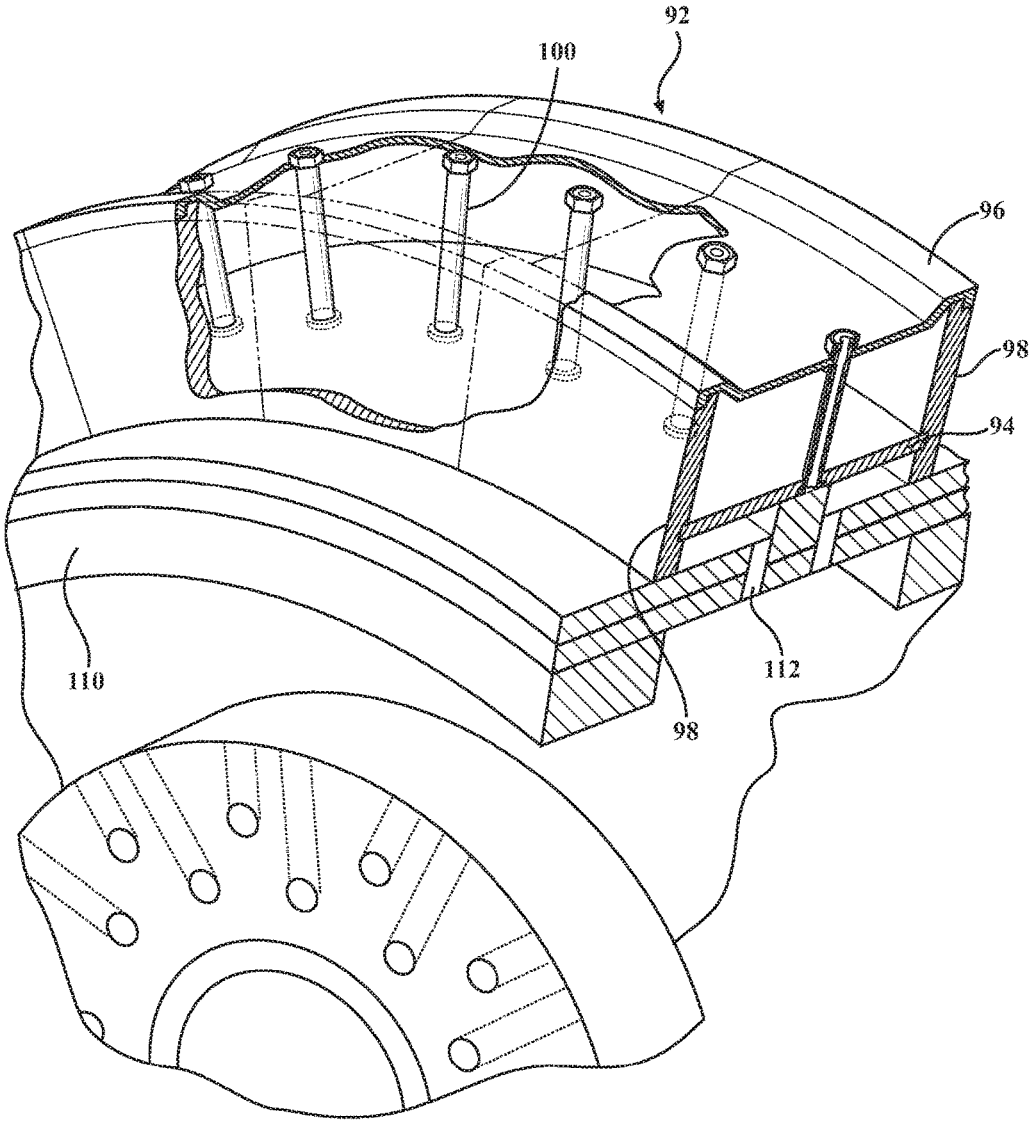
FIG. 7 is a partial sectional view of an oscillation plate of the compressor unit. Shown in the figure are hollow reinforcement rods, and a limited view of a center piece.
Figure 8:
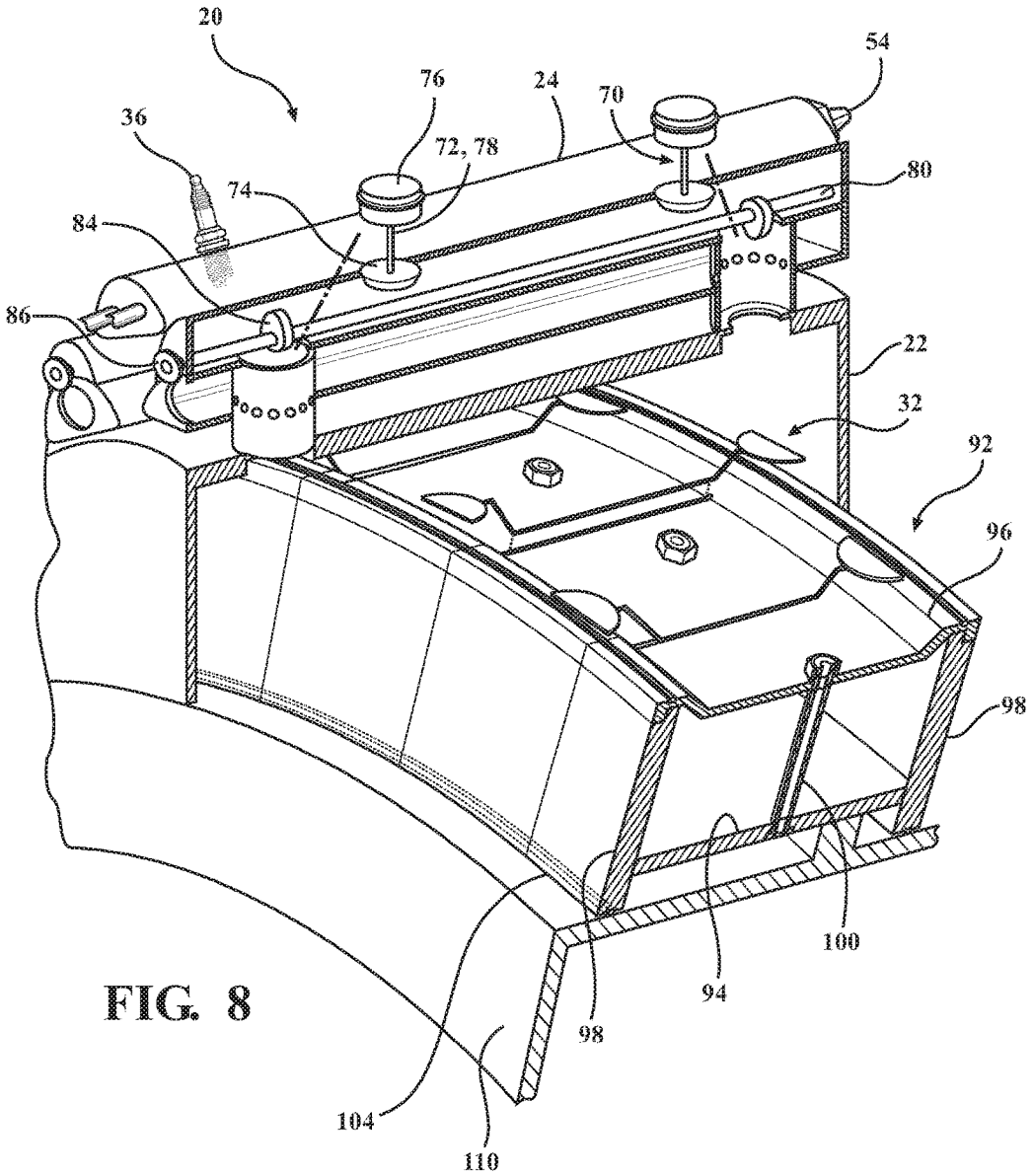
FIG. 8 is a partial sectional view of an intake system of the compressor unit showing an upper house of a camshaft and lobes, intake valves, and a lower air channel.

Shown in FIGS. 1-4, the compressor unit 20 includes an oscillation plate 92 disposed in the compression housing 22. The oscillation plate 92 is generally a cylindrical section. The oscillation plate 92 may be assembled from an inner hoop 94 segment, an outer hoop 96 segment, and two circular side panels 98. The inner and outer hoop 94, 96 segments interlock with the two side panels 98 to assemble the oscillation plate 92. A hollow reinforcement rod 100, shown in FIGS. 7 and 8, couples the two hoop segments 94, 96 and strengthens the oscillation plate 92. The side panels 98 define an axis 102 perpendicular to the side panels 98 and through a center of the circular side panels 98. The side panels 98 further define a bore 104 along the axis through the oscillation plate 92. In one embodiment, as shown in FIGS. 3 and 4, additional oscillation plates 92 are similarly disposed in the compression housing 22. Another embodiment is shown in FIGS. 1 and 2 with one oscillation plate 92.

Referring back to FIG. 3, each oscillation plate 92 separates the compression chamber 32 into a first portion 106 and a second portion 108. Movement of oscillation plate 92 into the first position compresses air in the first portion 106 of the compression chamber 32. Movement of the oscillation plate 92 between the first and second positions compresses air in the respective portion 106, 108 of the compression chamber 32 and moves the air across the exhale port 28 into the combustion chamber 26. In one embodiment, each oscillation plate 92 is disposed in an additional compression chamber 32 defined by the compression housing 22.

A center piece 110 supports the oscillation plate 92 for reciprocal movement in the compression housing 22. The center piece 110 is disposed in the bore 104 in the oscillation plate 92. The oscillation plate 92 is disposed around the center piece 110. The oscillation plate 92 is movable along the axis 102 and relative to the center piece 110 between a first position and a second position. The center piece 110 includes a plurality of fluid passages 112 configured to exchange fluid through the center piece 110.

Two fluid chambers are defined between each oscillation plate 92 and the center piece 110, a first fluid chamber 114 and a second fluid chamber 116. The first fluid chamber 114 and the second fluid chamber 116 are separated by a raised barrier. Fluid pressure within either fluid chamber 114, 116 causes the oscillation plate 92 to move respectively between the first position and the second position. Fluid pressure within the first fluid chamber 114 moves the oscillation plate 92 into the first position. Fluid pressure in the second fluid chamber 116 moves the oscillation plate 92 into the second position. Each fluid chamber 114, 116 is in fluid communication with one of the fluid passages 112.

During operation of a twin compressor, the oscillation plates 92 may move toward and then apart from each other. In one embodiment, the oscillation plates 92 are designed to clap and separate to reduce vibration. A first oscillation plate is in the first position while a second oscillation plate is in the second position.

As shown in FIG. 2, the compressor unit 20 includes a plurality of intake valves 70 disposed in the compression housing 22. Each intake valve 70 provides a source of air into the compression chamber 32. The plurality of intake valves 70 are radially arranged on the compression housing 22. Each intake valve 70 has an elongate stem portion 72 and a head portion 74. Each intake valve 70 has an open position and a closed position. The open position allows air to flow through the intake valve 70 and into the compression chamber 32. In the closed position, each intake valve 70 seals the compression chamber 32. A cam follower 76 is arranged at a distal end 78 of the stem portion 72. The cam follower 76 follows a camshaft 80 and transfers motion from the camshaft 80 to the intake valves 70 via lobes 84.

Figure 5:
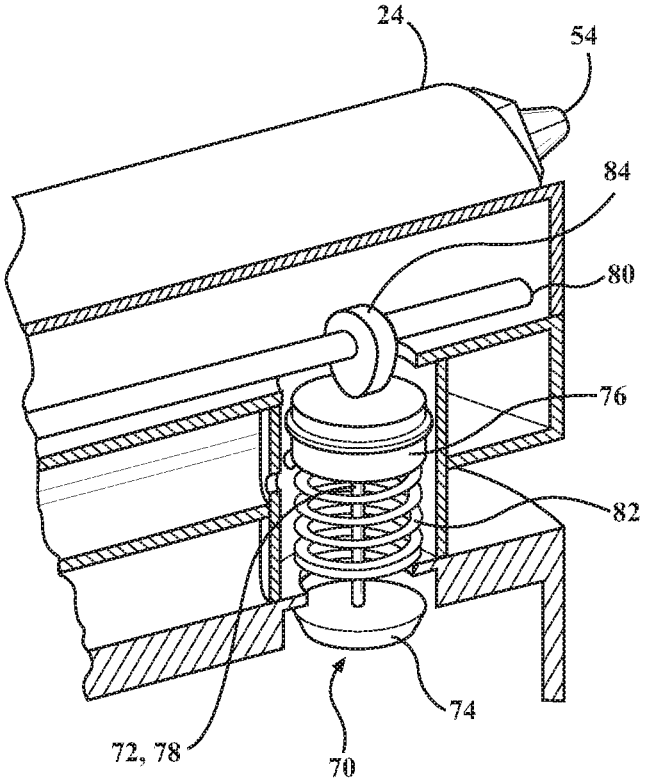
FIG. 5 is a partial sectional view of a vented intake port complete with an intake valve and an intake valve spring. A camshaft and a lobe are also shown.

The compressor unit 20 includes an intake valve spring 82 disposed about each intake valve 70 to bias the intake valve 70 toward the closed position, best shown in FIG. 5. The intake valve spring 82 may be secured to the stem portion 72 of the intake valve 70. The intake valve spring 82 may be a helically wound cylindrical type spring; however, it is to be appreciated that the intake valve spring 82 may take other forms, such as frustoconical or beehive, as is commonly known in the art.

The camshaft 80 is disposed in communication with each intake valve 70 to control the position of the intake valve 70. The camshaft 80 includes a plurality of eccentric lobes 84 fixed to the camshaft 80 and adjacent to each intake valve 70. The lobes 84 contact the cam followers 76 at the distal end 78 of each intake valve 70. Each lobe 84 slides on the cam follower 76 to open the intake valve 70. The intake valve spring 82 biases the intake valve 70 toward the closed position and maintains contact between the cam follower 76 and the lobe 84. It should be appreciated that the compressor unit 20 may include multiple camshafts 80 arranged radially on the compression housing 22.

Figure 12:
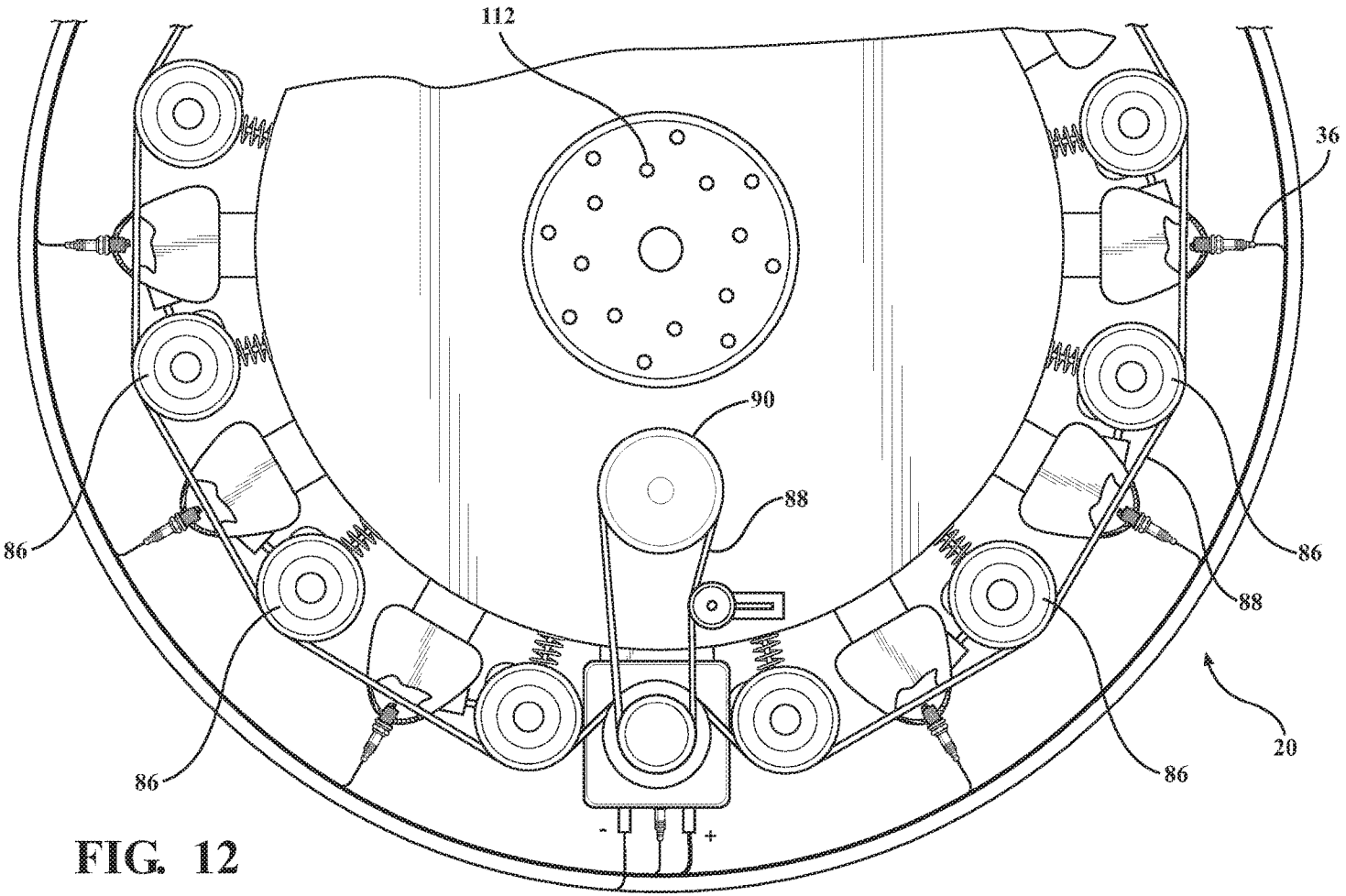
FIG. 12 is a face view of the compressor unit showing belt driven drive pulleys, and a drive source connected to the drive pulleys. Also, the belt drives an alternator that supplies electricity for the compressor unit.
Figure 13:
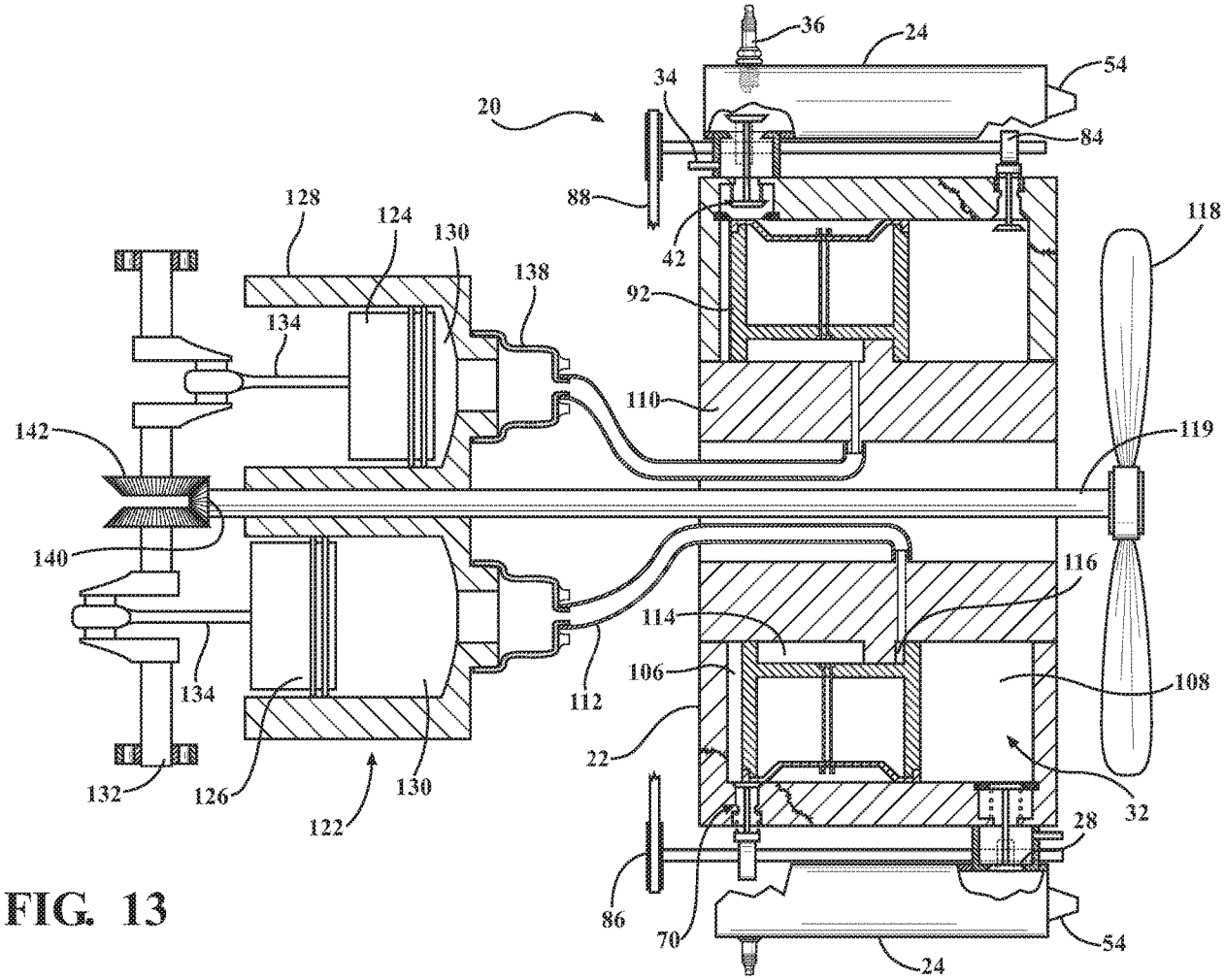
FIG. 13 is a sectional view of a motor unit according to another embodiment of the present invention.
Figure 14:
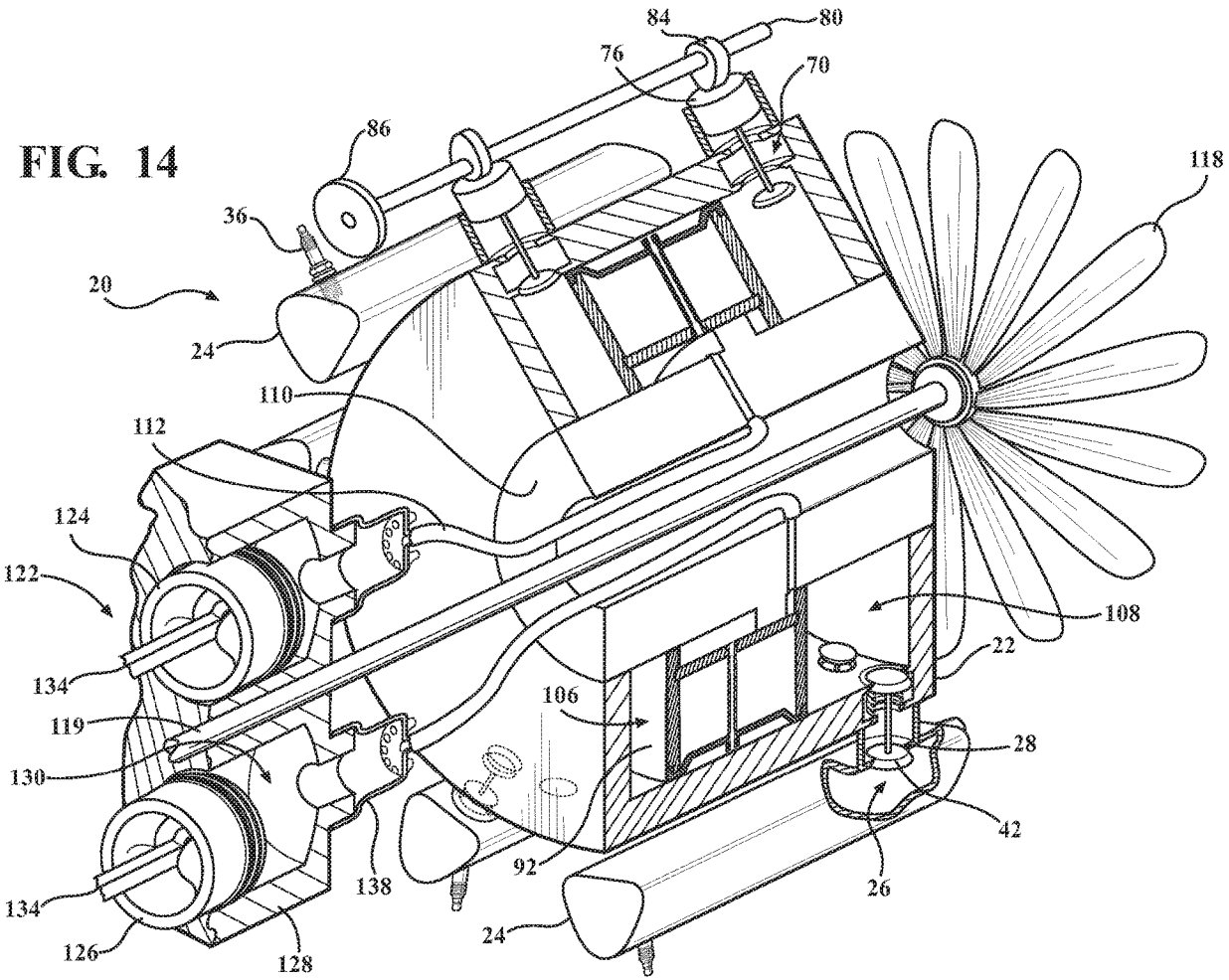
FIG. 14 is a sectional view of a motor unit according to another embodiment of the present invention.
Figure 15:
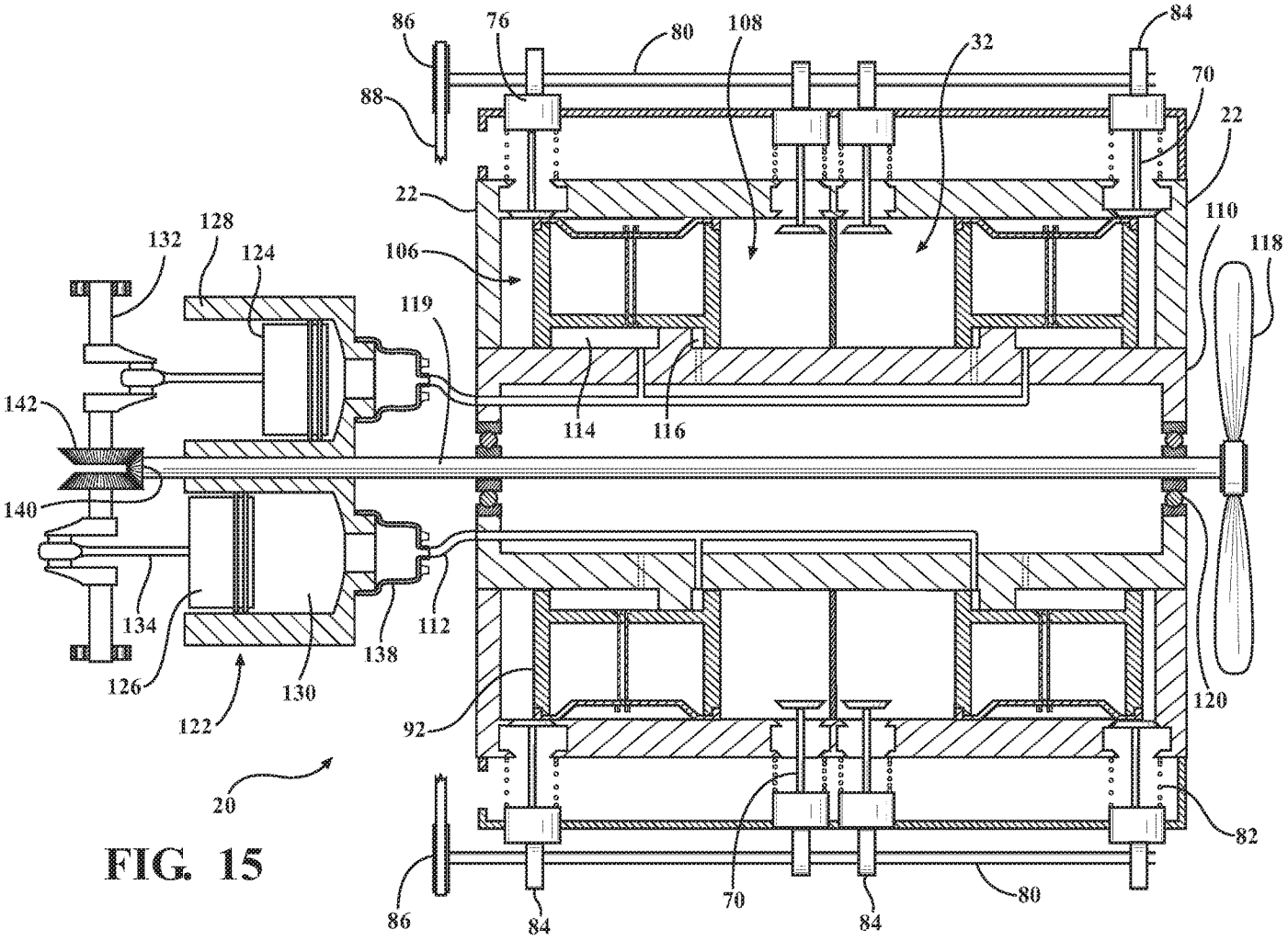
FIG. 15 is a sectional view of a twin motor unit according to one embodiment of the present invention.
Figure 16:
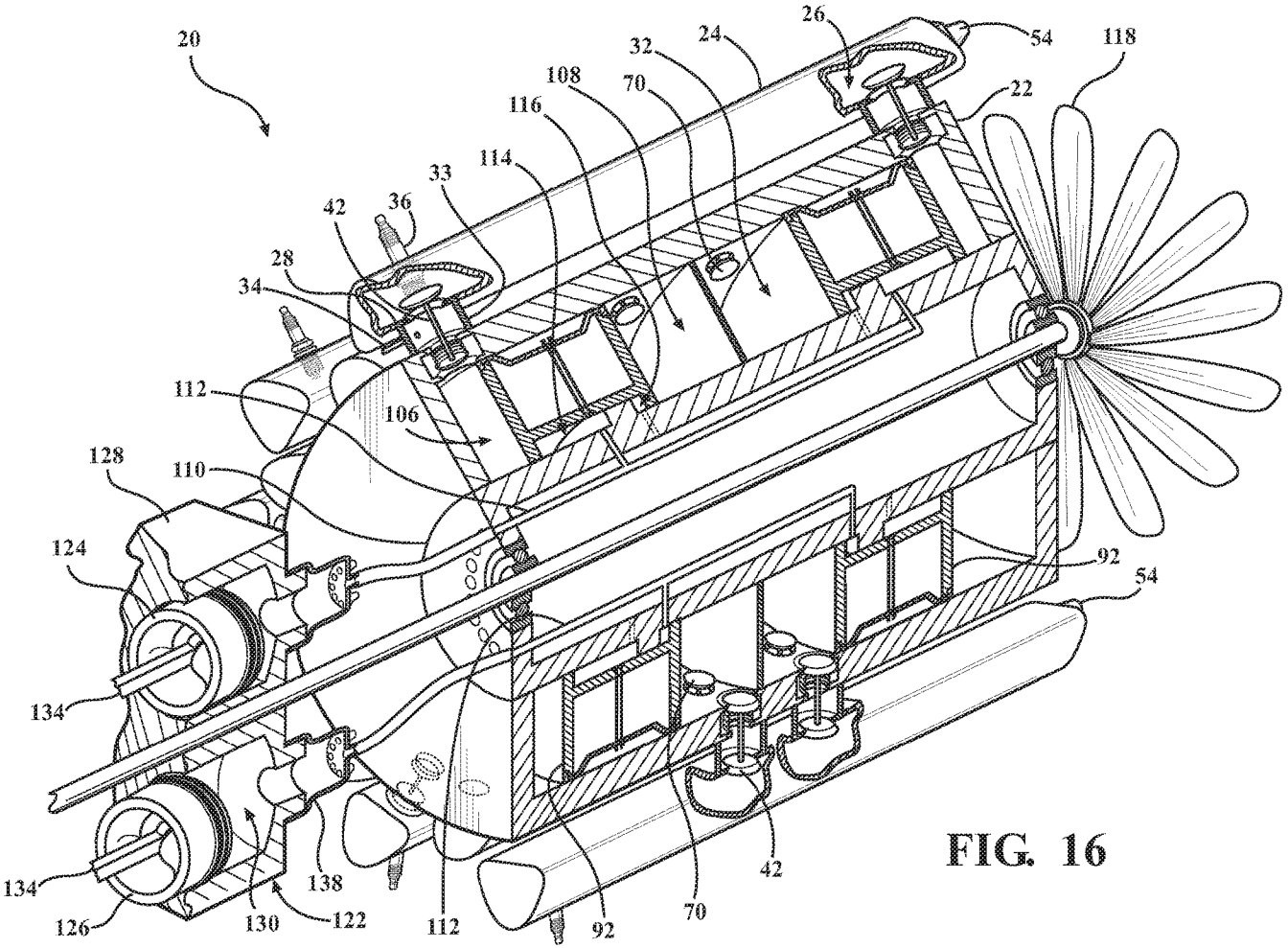
FIG. 16 is a partial sectional view of another portion of the twin motor unit according to one embodiment of the present invention.

A plurality of pulley wheels 86 are shown in FIG. 12. The pulley wheels 86 are coupled to each camshaft 80 to rotate the camshaft 80 in sync with operation of the compressor unit 20. A serpentine belt 88 operably links each pulley wheel 86 with a drive source 90, wherein the serpentine belt 88 is configured to rotate the pulley wheel 86. The serpentine belt 88 transfers rotational motion from the drive source 90 to the pulley wheel 86. It is to be appreciated that the serpentine belt 88 may take different forms such as a toothed belt or a chain drive.

Figure 6:
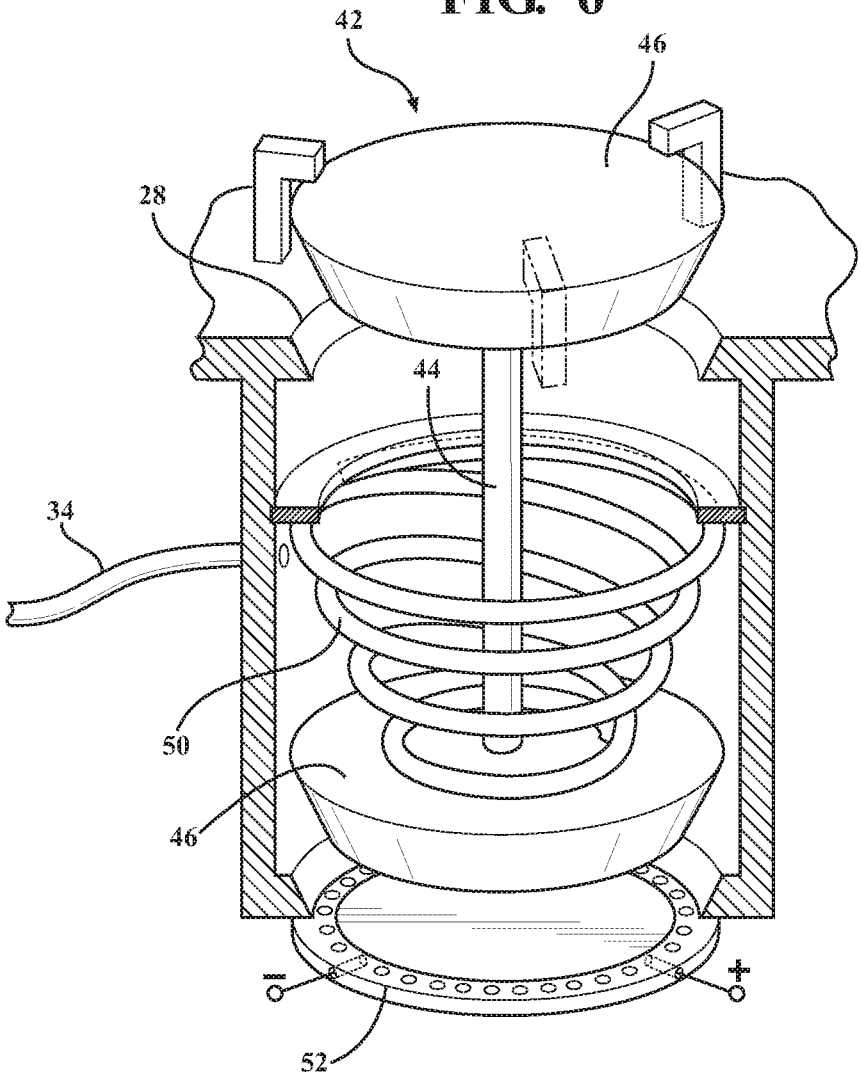
FIG. 6 is a partial sectional view of a pipe segment. The figure includes an exhale valve, an exhale valve spring, and a magnetic valve seat.

The compressor unit 20 includes a fuel injector 34 operatively attached to each of the pipe segments 33 of the combustion housings 24, as shown in FIG. 6. The fuel injector 34 is configured to direct fuel into the pipe segment 33 for use in combustion. A pressurized fuel source (not shown) supplies fuel to the fuel injector 34.

Referring again to FIG. 1, the compressor unit 20 includes an ignitor 36 operatively attached to the combustion housing 24 and disposed in communication with the combustion chamber 26. The ignitor 36 is used to initiate an explosive reaction wherein the fuel in the combustion chamber 26 is ignited and rapidly burns. The ignitor 36 may initiate the explosive reaction by way of an electrical arc or spark or by providing a heat source. The ignitor 36 may take several forms such as a spark plug, a glow plug, and other ignitors commonly known in the art.

The compressor unit 20 includes an exhale valve assembly including an exhale valve 42 arranged adjacent to each of the exhale ports 28 of each of the combustion housings 24 and configured to meter air into the combustion chamber 26. Referring to FIG. 6, the exhale valve 42 has an elongate stem portion 44 and two head portions 46 arranged at each end of the stem portion 44. The head portions 46 may be substantially circular in shape. The exhale valve 42 is moveable between an open position and a closed position. The open position permits air to flow into the combustion housing 24. A first head portion of the exhale valve 42 seals the exhale port 28 in the combustion housing 24. A second head portion of the exhale valve 42 seals against a magnetic valve seat 48 disposed in the compression housing 22.

The exhale valve assembly also includes an exhale valve spring 50 disposed about each of the exhale valves 42 to bias the exhale valve 42 into a closed position. The exhale valve spring 50 may be arranged between the second head portion of the exhale valve 42 and the compression housing 22. The exhale valve spring 50 may be a helically wound frusto-conical type spring; however, it is to be appreciated that the exhale valve spring 50 may take other forms, such as cylindrical or beehive, as is commonly known in the art.

The valve seat 48 is disposed in the compression housing 22 adjacent to the exhale valve 42 and spaced from the exhale port 28. The magnetic valve seat 48 includes a magnet 52 to bias the exhale valve 42 in a closed position. The magnet 52 creates an attraction force between the magnetic valve seat 48 and the exhale valve 42. The attraction force further biases the exhale valve 42 toward the closed position. The magnet 52 holds the exhale valve 42 in the closed position until pressure in the compression chamber 32 is great enough to turn off the attraction force and allow the exhale valve 42 to open. The magnet 52 reduces a valve float effect by requiring an elevated pressure within the compression housing 22 to turn off the attraction force from the magnet 52. The pressure that turns off the attraction force of the magnet 52 is greater than the initial pressure required to open the exhale valve 42 by the exhale valve spring 50. By reducing the valve float effect, greater pressure can be generated in the compression housing 22 before it is released into the combustion chamber 26. In one embodiment the magnet 52 is an electro-magnet, but permanent magnets are additionally contemplated.

Figure 10:
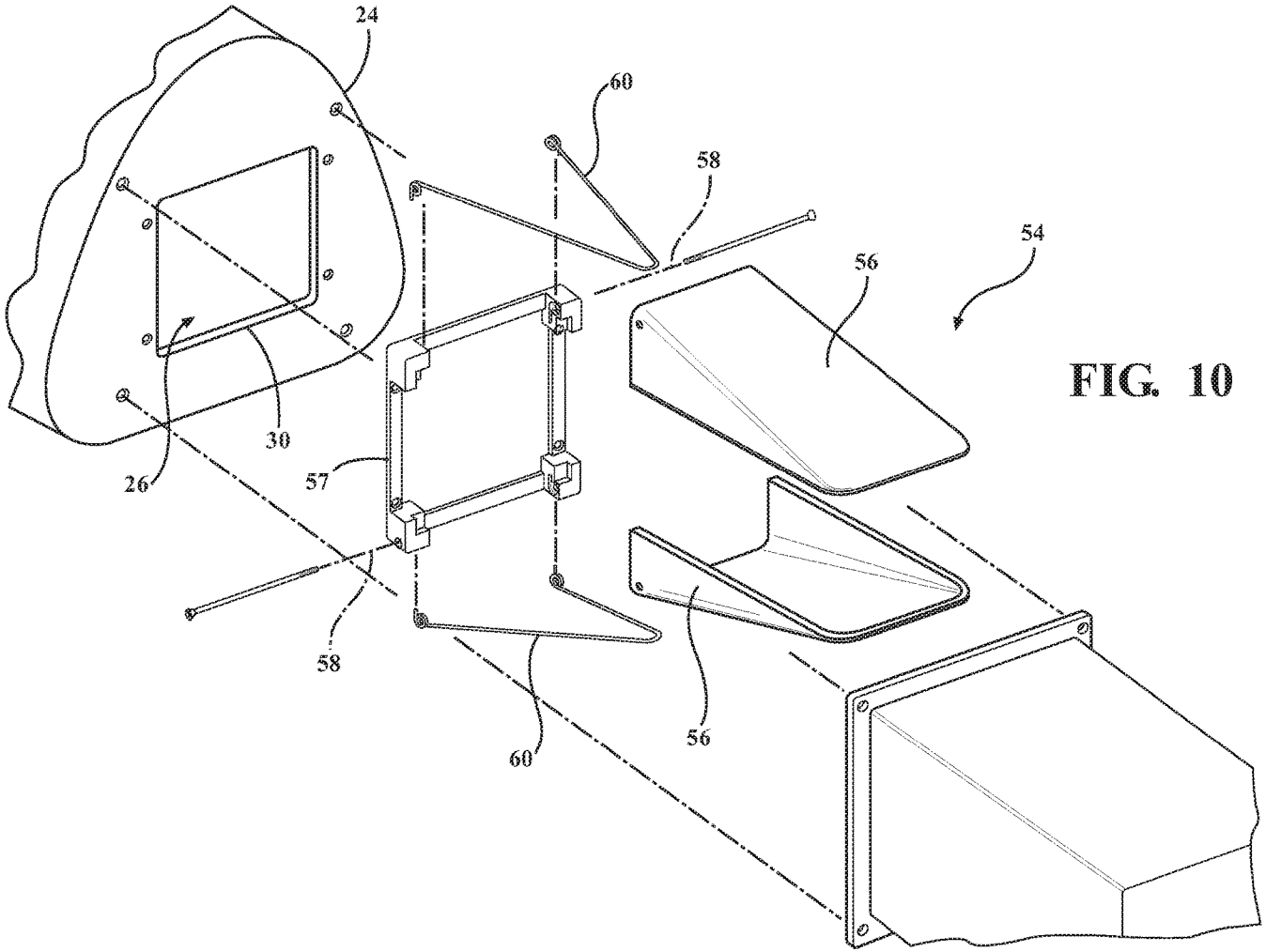
FIG. 10 is an exploded perspective view of a release valve according to one embodiment of the present invention.

The compressor unit 20 includes a release valve 54 arranged adjacent to the exhaust port 30 of each of the combustion housings 24 to meter exhaust out of the combustion chamber 26, as shown in FIG. 1 and FIG. 10. The release valve 54 includes a plurality of sealing panels 56 pivotally mounted to a release valve base 57, shown best in FIG. 10. The plurality of sealing panels 56 includes a first sealing panel and a second sealing panel, each pivotally mounted to the release valve base 57. The sealing panels 56 each pivot about a pivot axis 58. The first and second sealing panels 56 pivot toward each other to form a seal. A spring 60 is mounted to the release valve 54 on the pivot axis 58 and biases each sealing panel 56 toward a sealed position. The spring 60 may be a mousetrap spring; however, a torsion spring is also contemplated.

Figure 11:
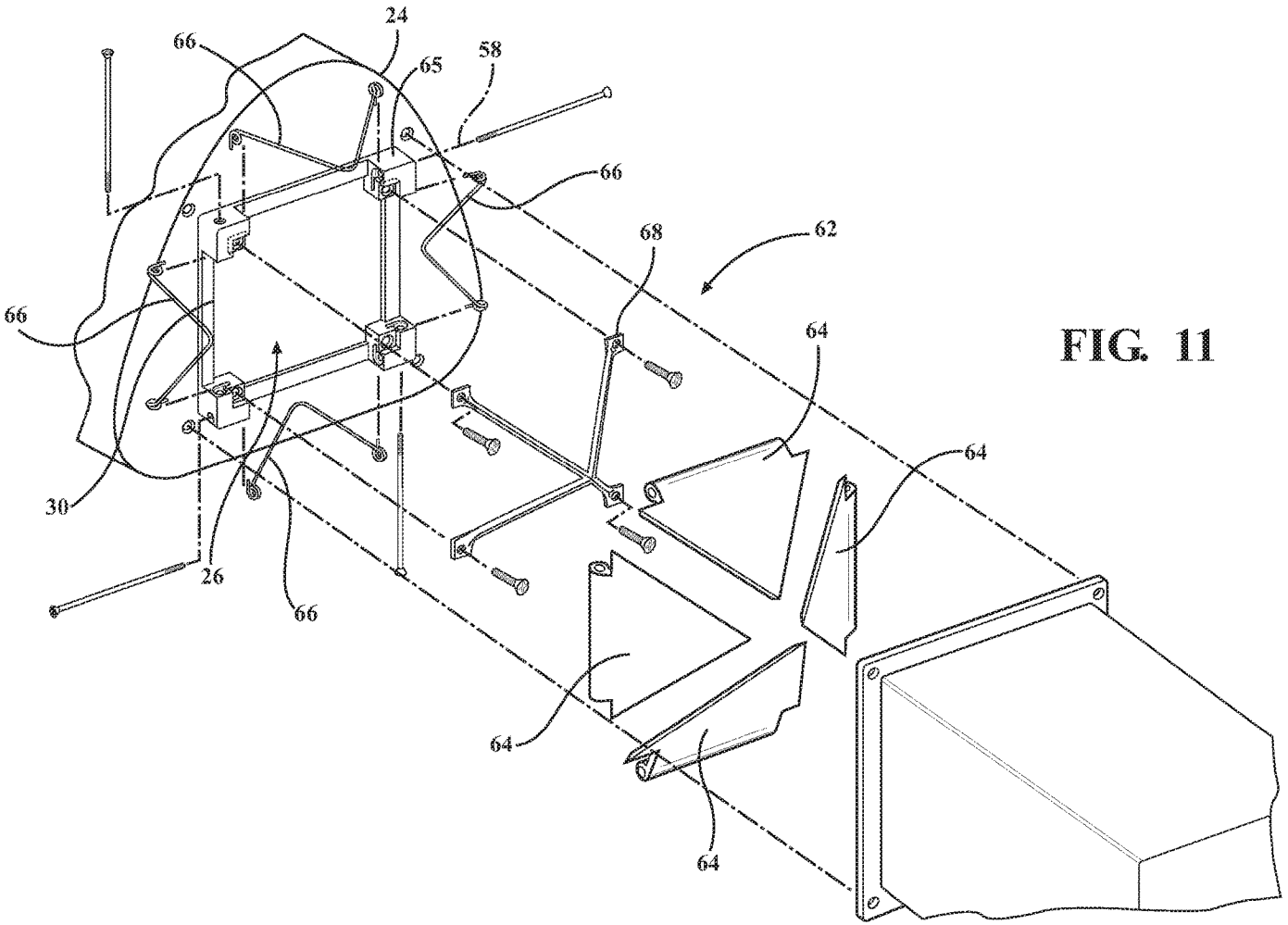
FIG. 11 is an exploded perspective view of another embodiment of a release valve according to one embodiment of the present invention.

Another embodiment of a release valve 62 is shown in FIG. 11. The release valve 62 includes a plurality of sealing panels 64 pivotally mounted to a release valve base 65. The plurality of sealing panels 64 includes four sealing panels, each pivotally mounted to the release valve base 65. The sealing panels 64 each pivot about a pivot axis 58. A seal frame 68 is coupled to the release valve 62 and supports the sealing panels 64. The sealing panels 64 pivot toward the seal frame 68 to form a seal. A spring 66 is mounted to the release valve 62 on the pivot axis 58 and biases each sealing panel 64 toward a sealed position. The spring 66 may be a mousetrap spring; however, a torsion spring is also contemplated.

The release valve 54 is opened by pressure in the combustion chamber 26. The spring 60 biases the sealing panels 56 toward the sealed position allowing air pressure in the combustion chamber 26 to increase. When the combustion chamber 26 pressure reaches a critical level, the pressure overcomes the spring 60 and opens the release valve 54. Excess pressure is released out of the combustion chamber 26. Once the pressure in the combustion chamber 26 falls below the critical level, the spring 60 closes the release valve 54, sealing the chamber.

Figure 9:
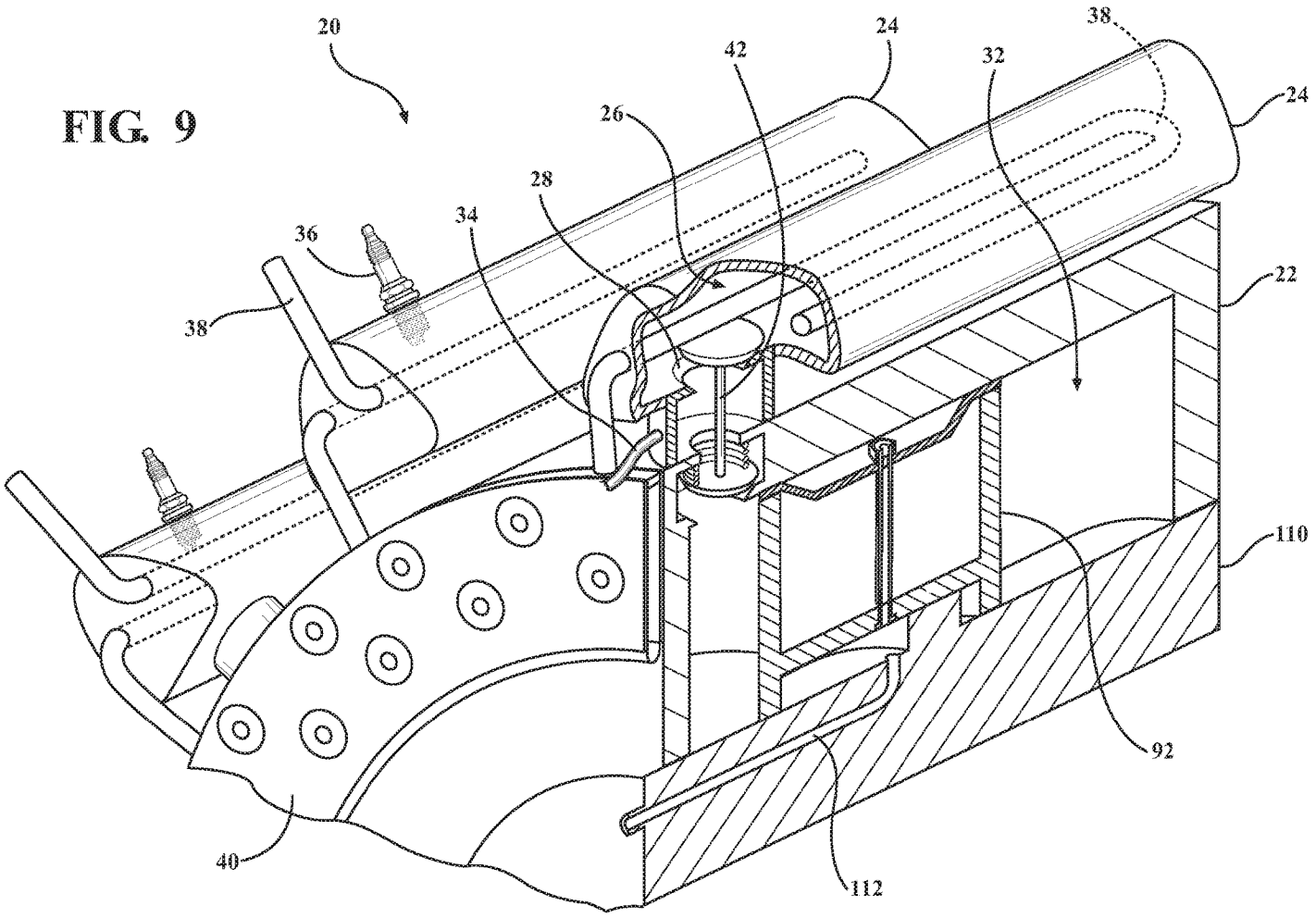
FIG. 9 is a partial sectional view of a combustion housing of a survival unit. The figure shows the combustion housing and heat exchanger and a condenser.

As shown in FIG. 9, a survival unit embodiment of the compressor unit 20 includes a heat exchanger 38 at least partially supported in the combustion chamber 26 and configured to heat water therethrough. Combustion in the combustion chamber 26 heats the heat exchanger 38, which transfers the heat into the water. The compressor unit 20 includes a condenser 40 fluidly coupled to the heat exchanger 38 to cool and store the water after heating. After the water has been heated, it flows out of the heat exchanger 38 into the condenser 40 where it can be used for various tasks such as bathing, cooking, and radiant heating. Optionally, heated water that is not immediately used may be cooled by the condenser 40 to be re-heated at a future time. The condenser 40 may serve as a primary source of water, supplied by the heat exchanger 38. It is further contemplated that the condenser 40 may serve as a source of drinking water.

The compressor unit 20 may include a heat fan 118 rotatably coupled to the center piece 110. The heat fan 118 includes a drive shaft 119. The drive shaft 119 is disposed in the center piece 110. Bearings 120 are arranged in the center piece 110 to support the drive shaft 119. Excess pressure and heat released from the release valve 54 flows over the heat fan 118 and influences the heat fan 118 to rotate. The heat fan 118 may further be coupled to an energy storage system (not shown) or other mechanical device.

The compressor unit 20 includes a piston pump 122 fluidly coupled to the fluid chambers 114, 116 to create fluid pressure. The piston pump 122 includes a first piston 124 fluidly coupled to the first fluid chamber 114 and a second piston 126 fluidly coupled to the second fluid chamber 116. A pump block 128 defines a plurality of pump cylinders 130. Each piston 124, 126 is operably disposed in one of the pump cylinders 130. The pistons 124, 126 each slide between top center and bottom center positions within the pump cylinders 130.

Each piston 124, 126 is operated in a reciprocal linear manner within the pump cylinders 130. In the embodiment shown, the pistons 124, 126 are coupled to a crankshaft 132 via a connecting rod 134. The connecting rod 134 transfers rotary motion from the crankshaft 132 into reciprocal linear motion of the pistons 124, 126. In a survival unit embodiment, the crankshaft 132 is powered by an external power source 136 such as a petrol engine, or an electric motor. The external power source 136 could also include a water wheel, windmill, and other renewable energy sources known in the art. It is additionally contemplated that the pistons 124, 126 are driven by a human powered mechanism such as a seesaw or treadwheel.

Each piston 124, 126 moves in opposite phase. While the first piston 124 is in the top center position, the second piston 126 is in the bottom center position. Opposite movement of the pistons 124, 126 pressurizes alternate fluid chambers 114, 116 independently and causes the oscillation plate 92 to reciprocate between the first position and the second position.

The pump cylinders 130 are in fluid communication with the fluid passages 112 in the center piece 110. A block cap 138 is configured to couple the pump cylinders 130 to the fluid passages 112. The pistons 124, 126 displace fluid out of the pump cylinders 130 through the block caps 138 and fluid lines. The fluid flows to and through the fluid passages 112 and into the fluid chambers 114, 116 defined by the oscillation plate 92. Each piston 124, 126 affects fluid pressure in respective fluid chambers 114, 116.

Referring now to FIGS. 13-16, an additional embodiment is shown. In this embodiment, the heat fan 118 is operably coupled to the crankshaft 132. A transfer gear 140 is coupled to the drive shaft 119 and affects rotation of the crankshaft 132. Rotation of the heat fan 118 causes the drive shaft 119 and transfer gear 140 to rotate the crankshaft 132.

An illustrative operation cycle of the compressor unit 20 begins with the oscillation plate 92 in the second position. The compressor unit 20 is operated when the external power source 136 drives the pistons 124, 126 in an alternating manner. In one embodiment the external power source 136 is a petrol engine. It is additionally contemplated that a starting device such as a pull-cord or an electric starter may initiate operation of the compressor unit 20. The external power source 136 is operably coupled to the crankshaft 132. The crankshaft 132 transmits the rotary motion of the external power source 136 into linear motion of the pistons 124, 126 via connecting rods 134.

Each pump cylinder 130 of the piston pump 122 is filled with a fluid. The first piston 124 pumps the fluid out of the piston pump 122 and into the first fluid chamber 114. Fluid pressure increases in the first fluid chamber 114 and causes the oscillation plate 92 to move into the first position.

The intake valve 70 in the first portion 106 of the compression chamber 32 is initially in the open position, allowing air to flow into the first portion 106 of the compression chamber 32. The intake valve 70 closes as the oscillation plate 92 moves out of the second position and into the first position. As the oscillation plate 92 moves out of the second position and into the first position, the intake valve 70 in communication with the second portion 108 of the compression chamber 32 is opened by the camshaft 80. The intake valve 70 allows air to enter the second portion 108 of the compression chamber 32.

The movement of the oscillation plate 92 compresses the air in the first portion 106 of the compression chamber 32 until the oscillation plate 92 reaches the first position. When peak pressure is reached in the first portion 106 of the compression chamber 32, the exhale valves 42 in communication with the first portion 106 of the compression chamber 32 open and release air into the combustion chamber 26. The exhale valves 42 close when the pressure between the first portion 106 of the compression chamber 32 and the combustion chamber 26 equalizes. The fuel injector 34 injects fuel into the pipe segment 33 before it is pressure sprayed into the combustion chamber 26 under pressure.

With the exhale valves 42 closed, the camshaft 80 opens the intake valves 70 in the first portion 106 of the compression chamber 32 and closes the intake valves 70 in the second portion 108 of the compression chamber 32. The second piston 126 in the piston pump 122 moves from the bottom center position toward the top center position. The second piston 126 forces fluid out of the pump cylinder 130 and into the second fluid chamber 116. Fluid in the second fluid chamber 116 creates a force that moves the oscillation plate 92 from the first position toward the second position.

The air and fuel in the combustion chamber 26 is ignited by the ignitor 36 creating an increase in heat and pressure in the combustion chamber 26. The heat produced by igniting the fuel and air is transferred into the heat exchanger 38 and thereby heats the water. The pressure produced by igniting the fuel and air increases until it reaches a critical level. At the critical level the pressure forces the release valve 54 open. Exhaust flows out of the combustion chamber 26 through the release valve 54 and into the heat fan 118, inducing rotation. When the pressure in the combustion chamber 26 falls below the critical level, the release valve 54 closes.

The movement of the oscillation plate 92 toward the second position compresses the air in the second portion 108 of the compression chamber 32 until the oscillation plate 92 reaches the second position. When peak pressure is reached in the second portion 108 of the compression chamber 32, the exhale valves 42 in communication with the second portion 108 of the compression chamber 32 open and release air into the combustion chamber 26. The exhale valves 42 close when the pressure between the second portion 108 of the compression chamber 32 and the combustion chamber 26 equalizes. The fuel injector 34 injects fuel into the pipe segment 33 before it is pressure sprayed into the combustion chamber 26 under pressure.

Unheated water flows into the heat exchanger 38 to be heated. The fuel and air in the combustion chamber 26 is ignited to heat the heat exchanger 38. Exhaust from combustion flows out of the combustion chamber 26 through the release valve 54 in a manner consistent with the above description. The entire operation cycle of the compressor unit 20 is repeated as described, until deactivated.

In another embodiment as shown in FIGS. 13-16, the operation cycle of the compressor unit 20 begins with the oscillation plate 92 in the second position. The rotation of the heat fan 118 rotates the drive shaft 119 and transfer gear 140. The transfer gear 140 transfers power to the crankshaft 132. The crankshaft 132 transmits the rotary motion of the external power source 136 into linear motion of the pistons 124, 126 via connecting rods 134. It is contemplated that a starting device such as a pull-cord or an electric starter may initiate operation of the compressor unit 20.

Each pump cylinder 130 of the piston pump 122 is filled with a fluid. The first piston 124 pumps the fluid out of the piston pump 122 and into the first fluid chamber 114. Fluid pressure increases in the first fluid chamber 114 and causes the oscillation plate 92 to move into the first position.

The intake valve 70 in the first portion 106 of the compression chamber 32 is initially in the open position, allowing air to flow into the first portion 106 of the compression chamber 32. The intake valve 70 closes as the oscillation plate 92 moves out of the second position and into the first position. As the oscillation plate 92 moves out of the second position and into the first position, the intake valve 70 in the second portion 108 of the compression chamber 32 is opened by the camshaft 80. The intake valve 70 allows air to enter the second portion 108 of the compression chamber 32.

The movement of the oscillation plate 92 compresses the air in the first portion 106 of the compression chamber 32 until the oscillation plate 92 reaches the first position. When peak pressure is reached in the first portion 106 of the compression chamber 32, the exhale valves 42 in communication with the first portion 106 of the compression chamber 32 open and release air into the combustion chamber 26. The exhale valves 42 close when the pressure between the first portion 106 of the compression chamber 32 and the combustion chamber 26 equalizes. The fuel injector 34 injects fuel into the pipe segment 33 before it is pressure sprayed into the combustion chamber 26 under pressure.

With the exhale valves 42 closed, the camshaft 80 opens the intake valves 70 in the first portion 106 of the compression chamber 32 and closes the intake valves 70 in the second portion 108 of the compression chamber 32. The second piston 126 in the piston pump 122 moves from the bottom center position toward the top center position. The second piston 126 forces fluid out of the pump cylinder 130 and into the second fluid chamber 116. Fluid in the second fluid chamber 116 creates a force that moves the oscillation plate 92 from the first position toward the second position.

The air and fuel in the combustion chamber 26 is ignited by the ignitor 36, creating an increase in heat and pressure in the combustion chamber 26. The heat produced by igniting the fuel and air is transferred into the heat fan 118 and the drive shaft 119. The pressure produced by igniting the fuel and air increases until it reaches a critical level. At the critical level the pressure forces the release valve 54 open. Exhaust flows out of the combustion chamber 26 through the release valve 54 and into the heat fan 118 inducing rotation. When the pressure in the combustion chamber 26 falls below the critical level, the release valve 54 closes.

The rotation of the heat fan 118 and drive shaft 119 is transferred back to the crankshaft 132 via the transfer gear 140. The movement of the oscillation plate 92 toward the second position compresses the air in the second portion 108 of the compression chamber 32 until the oscillation plate 92 reaches the second position. When peak pressure is reached in the second portion 108 of the compression chamber 32, the exhale valves 42 in communication with the second portion 108 of the compression chamber 32 open and release air and fuel into the combustion chamber 26. The exhale valves 42 close when the pressure between the second portion 108 of the compression chamber 32 and the combustion chamber 26 equalizes. The fuel injector 34 injects fuel into the pipe segment 33 before it flows into the combustion chamber 26.

The fuel and air in the combustion chamber 26 is ignited and drives the heat fan 118. Exhaust from combustion flows out of the combustion chamber 26 through the release valve 54 in a manner consistent with the above description. The entire operation cycle of the compressor unit 20 is repeated as described, until deactivated.

The present invention has been described in an illustrative manner. It is to be understood that the terminology which has been used is intended to be in the nature of words of description rather than of limitation. Many modifications and variations of the present invention are possible in light of the above teachings being a first to file. The present invention may be practiced other than as specifically described, as a reproduction of a first to file.

What is claimed is:

1. A survival unit comprising: at least one combustion housing defining a combustion chamber therein and further defining an exhale port providing a source of air into said combustion chamber and then an exhaust port providing an exit path for exhaust gasses; a heat exchanger at least partially supported in said combustion chamber and configured to heat water therethrough; an igniter operatively attached to said at least one combustion housing and disposed in communication with said combustion chamber; an exhale valve arranged adjacent to said exhale port of said at least one combustion housing and configured to meter air and fuel into said combustion chamber; a fuel injector operatively attached to said at least one combustion housing via a pipe segment and configured to direct fuel into said combustion chamber for use in combustion; an annular compression housing defining a compression chamber, said compression housing being separate from said combustion housing and spaced radially from said combustion chamber housing and said compression chamber being disposed in fluid communication with said combustion chamber is across and under such; an annular oscillation plate disposed in said compression chamber of said compression housing and supported for reciprocal movement in said compression chamber between first and second positions wherein movement of said oscillation plate between said positions compresses air directed toward said combustion chamber across said exhale port; and said oscillation plate comprising an inner hoop segment, an outer hoop segment forming concentric cylindrical side panels interlocked with said inner hoop segment and said out hoop segment.

2. A survival unit comprising: a combustion housing defining a combustion chamber therein and further defining an exhale port providing a source of air into said combustion chamber and then an exhaust port providing an exit path for exhaust gasses; a heat exchanger at least partially supported in said combustion chamber and configured to heat water therethrough; an igniter operatively attached to said combustion housing and disposed in communication with said combustion chamber; an exhale valve arranged adjacent to said exhale port of said combustion housing and configured to meter air and fuel into said combustion chamber; a fuel injector operatively attached to said combustion housing via a pipe segment and configured to direct fuel into said combustion chamber for use in combustion; a compression housing defining a compression chamber, said compression housing being separate from said combustion housing and spaced from said combustion housing and said compression chamber being disposed in fluid communication with said combustion chamber; an oscillation plate disposed in said compression chamber of said compression housing and supported for reciprocal movement in said compression chamber between first and second positions wherein movement of said oscillation plate between said positions compresses air directed toward said combustion chamber across said exhale port; a release valve arranged adjacent to said exhaust port of said combustion housing and configured to meter exhaust out of said combustion chamber; a valve seat disposed in said compression housing and adjacent to said exhale valve and including a magnet to bias said exhale valve into a closed position; a center piece wherein said oscillation plate is disposed around said center piece and defines a fluid chamber, wherein fluid pressure within said fluid chamber causes said oscillation plate to move between said first position and said second position relative to said center piece; and wherein said oscillation plate is a cylindrical section comprising an inner hoop segment, an outer hoop segment forming concentric cylindrical side panels interlocked with said inner hoop segment and said out hoop segment, said side panels defining an axis perpendicular to said cylindrical section, wherein said oscillation plate moves between said first and second positions along said axis, said movement is provided by fluid pressure below said oscillation plate, and said fluid pressure alternates on each side of a raised barrier that is placed around said center piece.

3. The survival unit as set forth in claim 1 further including a valve seat disposed in said compression housing and adjacent to said exhale valve and including a magnet to bias said exhale valve into a closed position.

4. The survival unit as set forth in claim 1 further including a valve spring disposed about said exhale valve to bias said exhale valve into a closed position.

5. A survival unit comprising: a combustion housing defining a combustion chamber therein and further defining an exhale port providing a source of air into said combustion chamber and then an exhaust port providing an exit path for exhaust gasses; a heat exchanger at least partially supported in said combustion chamber and configured to heat water therethrough; an igniter operatively attached to said combustion housing and disposed in communication with said combustion chamber; an exhale valve arranged adjacent to said exhale port of said combustion housing and configured to meter air and fuel into said combustion chamber; a fuel injector operatively attached to said combustion housing via a pipe segment and configured to direct fuel into said combustion chamber for use in combustion; a compression housing defining a compression chamber, said compression housing being separate from, said combustion housing and spaced radially from said combustion housing and said compression chamber being disposed in fluid communication with said combustion chamber; an oscillation plate disposed in said compression chamber of said compression housing and supported for reciprocal movement in said compression chamber between first and second positions wherein movement of said oscillation plate between said positions compresses air directed toward said combustion chamber across said exhale port; an intake valve disposed in said compression housing and configured to provide a source of air into said compression chamber; a center piece wherein said oscillation plate is disposed around said center piece and defines a fluid chamber, wherein fluid pressure within said fluid chamber causes said oscillation plate to move between said first position and said second position relative to said center piece; wherein said oscillation plate is a cylindrical section and defines an axis perpendicular to said cylindrical section, wherein said oscillation plate moves between said first and second positions along said axis, said movement is provided by fluid pressure below said oscillation plate, and said fluid pressure alternates on each side of a raised barrier that is placed around said center piece; and wherein said oscillation plate comprises an inner hoop segment, an outer hoop segment forming concentric cylindrical side panels interlocked with said inner hoop segment and said out hoop segment, and a hollow reinforcement rod coupled to each of said inner hoop segment and said outer hoop segment.

6. The survival unit as set forth in claim 5 further including a camshaft, wherein said camshaft is disposed in communication with said intake valve and configured to control said intake valve by a lobe.

7. The survival unit as set forth in claim 6 further including a pulley wheel coupled to said camshaft and a serpentine belt operably linked with said pulley wheel, wherein said serpentine belt is configured for rotating said pulley wheel.

8. The survival unit as set forth in claim 1 further including a center piece wherein said oscillation plate is disposed around said center piece and defines a fluid chamber, wherein fluid pressure within said fluid chamber causes said oscillation plate to move between said first position and said second position relative to said center piece.

9. The survival unit as set forth in claim 8 wherein said fluid chamber is further defined as a first fluid chamber and a second fluid chamber, wherein fluid pressure within said first fluid chamber moves said oscillation plate into said first position, and fluid pressure in said second fluid chamber moves said oscillation plate into said second position.

10. The survival unit as set forth in claim 9 further including a piston pump fluidly coupled to said fluid chamber to create fluid pressure.

11. The survival unit as set forth in claim 10 wherein said piston pump includes a first piston fluidly coupled to said first fluid chamber and a second piston fluidly coupled to said second fluid chamber, wherein said pistons each move between top center and bottom center positions in opposite phases creating fluid pressure in respective fluid chambers.

12. The survival unit as set forth in claim 1 wherein said oscillation plate is a cylindrical section and defines an axis perpendicular to said cylindrical section, wherein said oscillation plate moves between said first and second positions along said axis, said movement is provided by fluid pressure below said oscillation plate, and said fluid pressure alternates on each side of a raised barrier that is placed around a center piece.

13. The survival unit as set forth in claim 12 wherein said oscillation plate is disposed in said compression housing and said compression housing is a cylinder.

14. The survival unit as set forth in claim 12 further including said center piece to support said oscillation plate, wherein said oscillation plate defines a hole and said center piece is disposed around said hole and around a drive shaft within said hole.

15. The survival unit as set forth in claim 12 wherein said combustion housing is further defined as a plurality of combustion housings radially arranged about said compression housing and defining a plurality of combustion chambers therein in fluid communication with said compression chamber.

16. The survival unit as set forth in claim 2 wherein said release valve includes a plurality of sealing panels pivotally mounted to said release valve and a spring mounted to said release valve configured to bias said sealing panels toward a sealed position.

17. The survival unit as set forth in claim 16 wherein said spring is further defined as a mousetrap style spring.

18. The survival unit as set forth in claim 16 wherein said plurality of sealing panels are further defined as two sealing panels each pivotally mounted to said release valve and arranged to form a seal.

19. The survival unit as set forth in claim 1 wherein said oscillation plate includes a hollow reinforcement rod coupled to each of said inner hoop segment and said outer hoop segment.

20. The survival unit as set forth in claim 1 further including a condenser to cool and store the water after heating.

21. The survival unit as set forth in claim 11 further including a heat fan, wherein said heat fan is operably coupled to said piston pump to power said piston pump.

22. The survival unit as set forth in claim 21 further including a crankshaft configured to drive said piston pump, wherein said heat fan is coupled to said crankshaft via a drive shaft and a transfer gear.

23. The survival unit as set forth in claim 1 further including a crankshaft powered by an external power source.

* * * * *